United States Patent [19]

Jones et al.

[11] Patent Number: 4,840,609

[45] Date of Patent: Jun. 20, 1989

[54] BAG FOLDING MACHINE

[75] Inventors: Elwyn D. Jones, Kingston; Robert Lauzon, Montreal; Bruno Wetter, St-Eustache, all of Canada

[73] Assignee: Glopak Inc., Montreal, Canada

[21] Appl. No.: 89,155

[22] Filed: Aug. 25, 1987

[51] Int. Cl.[4] ..... B65H 33/02; B65H 33/08; B65H 37/06; B65H 45/30

[52] U.S. Cl. ..... 493/28; 493/418; 493/444; 493/450

[58] Field of Search ..... 493/186, 189, 231, 243, 493/246, 254, 204, 28, 29, 418, 444, 445, 447, 449, 458, 405, 395, 416, 450, 454, 480; 53/120, 429

[56] References Cited

U.S. PATENT DOCUMENTS 3,773,315 11/1973 Tsien ..... 493/450

FOREIGN PATENT DOCUMENTS 2023063 12/1979 United Kingdom ..... 493/254

*Primary Examiner*—Frederick R. Schmidt
*Assistant Examiner*—Jack W. Lavinder
*Attorney, Agent, or Firm*—Burns, Doane, Swecker & Mathis

[57] ABSTRACT

A method and a machine for folding bags comprising a first conveyor for positioning a flat bag over a first support surface. A pair of sealer bars holds the bag stationary over the first support surface in predetermined alignment with a first folding device. The first folding device effects a first fold to the flat bag and a second conveyor positions the folded bag on a second stationary support surface. A second folding device effects a second fold to the folded bag, and a third conveyor positions the twice folded bag onto a third stationary support surface. A third folding device is provided for imparting a third fold to the twice folded bag, and it includes an orientation support frame to position the bag for transferring same to a collector trough. A predetermined quantity of bags are collected in the collector trough, and identified for transfer into a container.

43 Claims, 3 Drawing Sheets

CONTROL
30

BAG FOLDING MACHINE

BACKGROUND OF INVENTION

1. Field of Invention

The present invention relates to a method and a machine for folding plastic bags. The machine is also capable of folding two or more bags together and accumulating a predetermined quantity of these bags for transfer into a carton. Particularly, but not exclusively, the folding machine is adapted for use at the output of a plastic bag making machine.

2. Description of Prior Art

Various machines are known to make plastic bags. Often, plastic bags are required to be folded for packaging in a carton or in a further plastic bag for retail. Various types of folding machines are known to fold such bags, and the present invention relates to an improved folding machine which is capable of folding and accumulating a predetermined quantity of bags as well as folding two or more bags together for later packaging in a convenient display bagger carton. There is also the need to provide a folding machine which is high speed so that it can be disposed at the outlet of a high speed plastic bag making machine.

SUMMARY OF INVENTION

It is a feature of the present invention to provide an improved bag folding machine capable of imparting a plurality of folds to one or more juxtaposed plastic bags, accumulating same and identifying a predetermined quantity of these bags for transfer into a container.

Another feature of the present invention is to provide a method of folding plastic bags, either one, or two or more juxtaposed plastic bags, and accumulating a predetermined quantity of these bags for transfer into a container.

Another feature of the present invention is to provide a method and a machine for folding plastic bags and which is capable of being associated with the output of a high speed plastic bag making machine and capable of folding one, or two or more plastic bags, and accumulating a predetermined quantity of these bags for transfer into a container.

According to the above features, from a broad aspect, the present invention provides a bag folding machine comprising first conveyor means for positioning a flat bag over a first support surface. Holding means is provided to hold the flat bag stationary over the first support surface in predetermined alignment with the first folding means. The first folding means effects a first fold to the flat bag. Second conveyor means is provided for positioning the folded bag on a second stationary support surface. Second folding means is also provided for effecting a second fold to the folded bag. A third conveyor means positions the twice folded bag onto a third stationary support surface. The third folding means imparts a third fold to the twice folded bag and includes orientation support means to position the bag for transferring same to a collector means.

According to a further broad aspect of the present invention there is provided a method of folding a plastic bag and comprising the steps of positioning a plastic bag over a first support surface. The plastic bag is then held over the first support surface in predetermined alignment with the first folding means. A first fold is effected to the plastic bag and it is then conveyed onto a second stationary support surface. A second fold is then effected to the first folded bag which is then conveyed onto a third stationary support surface. A third fold is effected to the second folded plastic bag. The bag is then oriented to a position for transfer into a collector means. The thrice folded plastic bag is then transferred into the collector means.

BRIEF DESCRIPTION OF DRAWINGS

A preferred embodiment of the present invention will now be described with reference to the example thereof, as illustrated in the accompanying drawings, in which.

Figure 1:
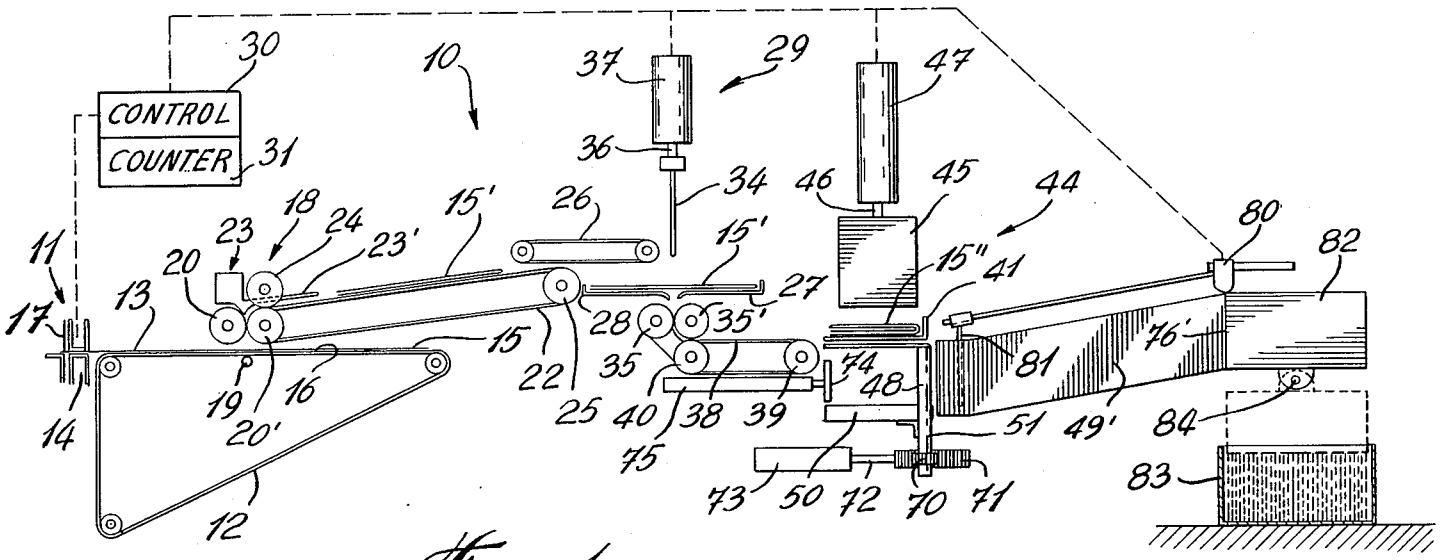
FIG. 1 is a simplified schematic side view of the bag folding machine of the present invention.
Figures 2, 5, 6:
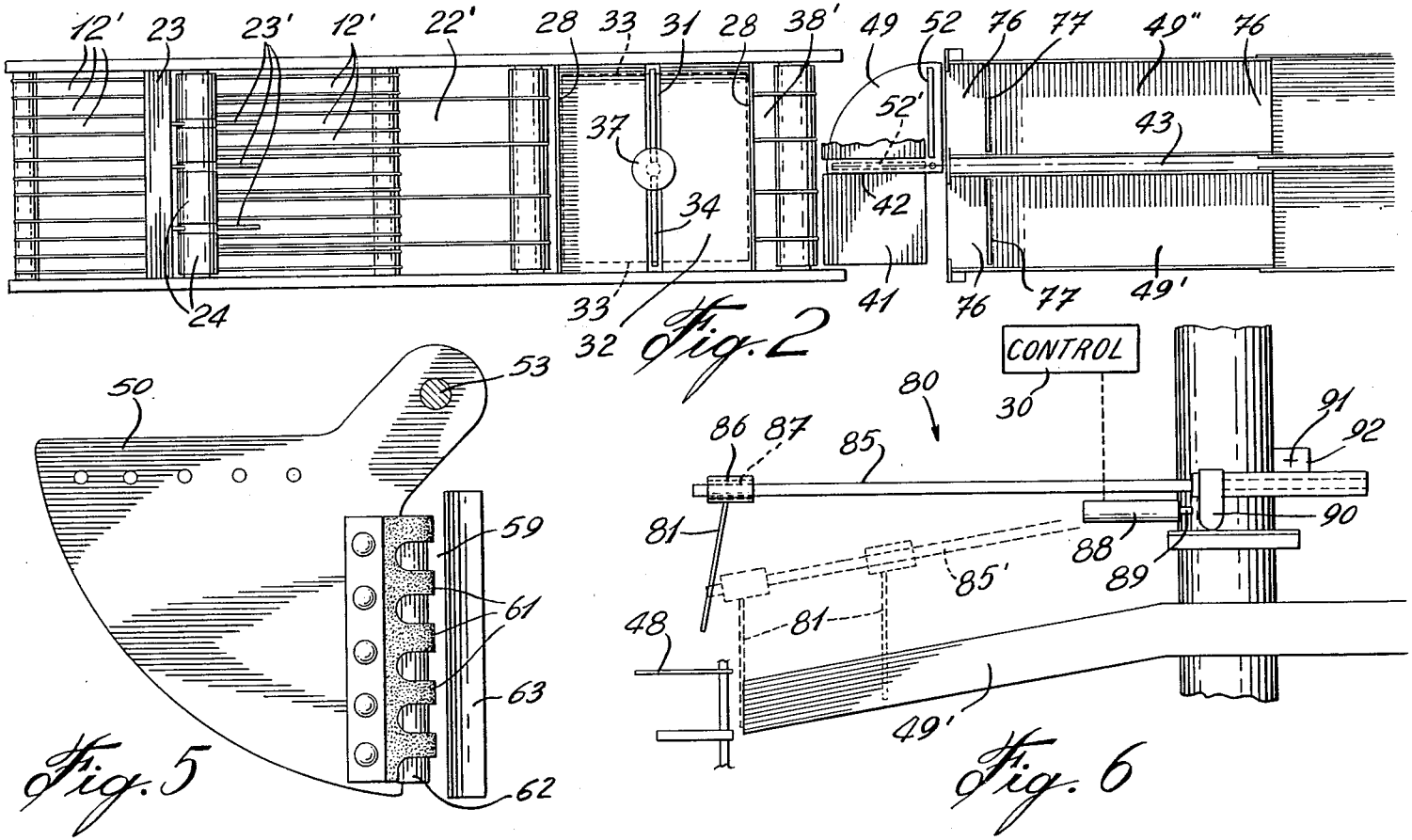
FIG. 2 is a top view of the bag folding machine of FIG. 1.
FIG. 5 is a top view of the retention channel in the lower quadrant plate.
FIG. 6 is a simplified side view of the indicating element to identify a predetermined quantity of bags in the collecting trough.

DESCRIPTION OF PREFERRED EMBODIMENTS p Referring to the drawings, and more particularly to FIGS. 1 and 2, there is shown generally at 10 the bag folding machine of the present invention. This machine is particularly adapted, although not exclusively, for use with the output section 11 of a plastic bag making machine. The output section of the bag making machine is provided with an output conveyor 12 on which is supported a hollow plastic film 13 forming opposed walls of a bag. This hollow film 13 is open ended and a pair of sealer bars 14 apply heat to the hollow plastic film 13 to form a closed end. A cutting knife 17 also severs the plastic film 13 immediately behind the sealer bars. Thus, a plastic bag 15 is formed on the support surface 16 of the output conveyor 12.

In the bag folding machine of the present invention the output conveyor 12 constitutes a first conveyor means and the support surface 16 thereof constitutes a first support surface. In order to impart a substantially central fold to the plastic bag 15, a first folding means, generally shown at 8, is provided. This first folding means is constituted by an air conduit 19 having upwardly directed jets, not shown but obvious to a person skilled in the art, disposed between the spaced apart belts 12' whereby to push a mid-length portion of the bag 15 between the pinch rolls 20 and 20'. However, in order to assure that the bag 15 is pinched at substantially mid-length thereof, air pressure is applied at the same time that the sealer bars are actuated. Accordingly, the sealer bars 14 constitute a holding means and once this holding means is released the bag 15 is immediately engaged by the pinch rolls 20 and 20' which are aligned . with the long axis of the conduit 19, and closely spaced to the bag 15 whereby the bag is immediately grasped and folded upon release from the sealer bars. A deflector, mechanism 23 is associated with the pinch rolls 20 and 20' and includes curved deflector fingers 23' which extend between a top one of a further set of pinch rolls consisting of a top pinch roll 24 associated with the bottom pinch roll 20'. Accordingly, as the plastic bag 15 is folded through the first set of pinch rolls 20 and 20', the bag is deflected onto a second conveyor 22 which is wound about the pinch roll 20' and a further drive roll 25. The conveyor 22 is also constituted by a plurality of conveyor belts 22' (see FIG. 2).

The once folded plastic bag 15' is then conveyed by the second conveyor 22 and a guide conveyor 26 onto a second stationary surface which is constituted by a first collector tray 27. This tray is provided with guide walls 28 to support one or more of the once folded bags 15' thereon and juxtaposed with one another. The folding machine 10 is provided with a controller device 30 which has a counter device 31 incorporated therewith to count the number of closures of the sealer bars 14. Each time the sealer bars open, a bag 15 is formed, and if it is necessary to fold two or more plastic bags 15' together, the controller 30 will effectuate the second folding operation only after two or more plastic bags 15' have been accumulated on the first collector tray 27.

A second folding means 29 is provided in association with the collector tray 27 and constituted by a slot 31 formed in the flat support wall 32 of the tray beyond opposed end edges 33 of the plastic bag 15' supported thereover. A fold former blade 34 is disposed above the first collector tray 27 and in alignment with the slot 31. The former blade 34 is actuated to push the bag or bags 15' through the slot 31 and into engagement with a second set of pinch rolls 35 and 35' disposed under the first collector tray 27 and in alignment with the slot 31 whereby to effect a second fold to the plastic bag or bags 15'. The former blade 34 is secured to a piston rod 36 which is actuated by piston 37 upon receipt of a command from the controller 30.

As shown in FIG. 1, the pinch roll 35 of the second folding means is provided with a belt conveyor 38 which also consists of spaced apart belts 38' and driven by a drive roll 39. A further pinch roll 40 is in engagement with the pinch roll 35' whereby to reorient, the second folded plastic bag 15 along a horizontal plane for discharging the twice folded bag 15'' onto a third stationary support surface which is herein constituted by a second stationary collector tray 41.

The second collector tray 41 is also provided with a slot 42 therein and substantially located centrally and disposed along the long axis 43 of the machine 10. A third folding means, generally shown at 44, is constituted by a further former blade 45 connected to a piston rod 46 of a further piston 47 which is also controlled by the controller 30. The former blade 45 engages the twice folded plastic bag or bags 15'' and substantially centrally thereof, and pushes it through the slot 42 and into an orientation bag support frame 48 which engage the thrice folded bag or bags and positions it for transfer into a collector trough 49'.

Figure 3:
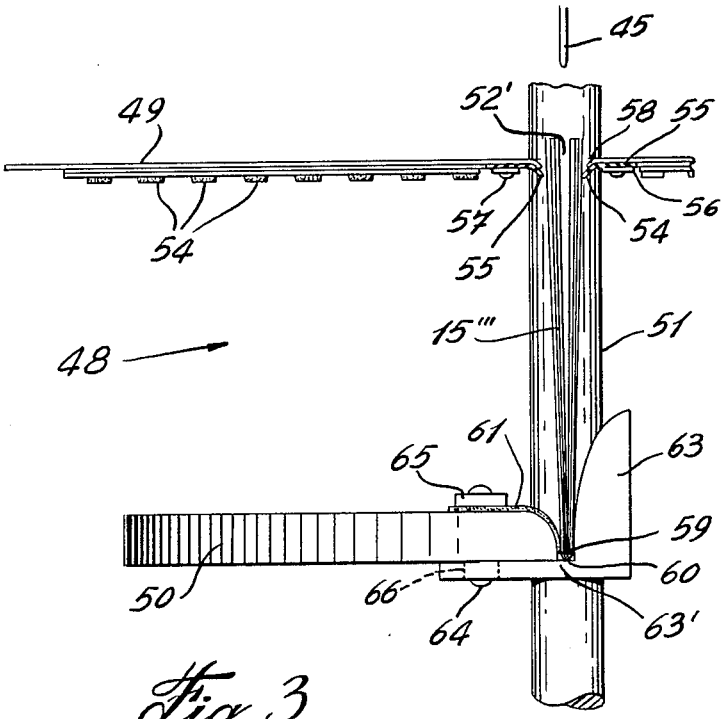
FIG. 3 is an enlarged view of the orientation support frame.
Figure 4:
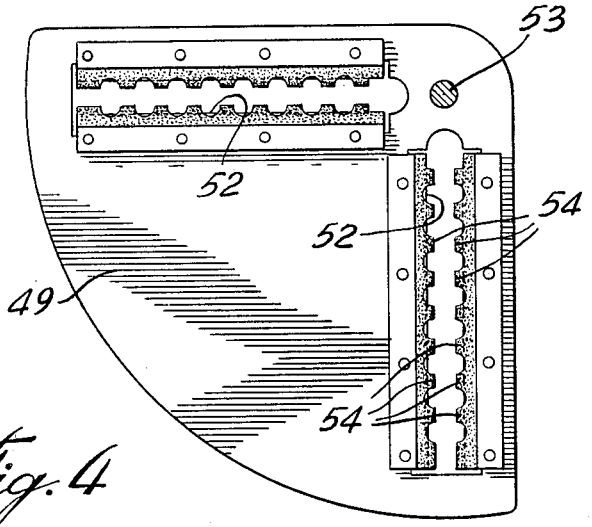
FIG. 4 is a top view of the upper quadrant plate of the bag engaging member.

Referring now additionally to FIGS. 3 to 5, action bag support frame 48. As herein shown, this frame is comprised of a pair of quadrant shaped plates which are spaced apart, and namely an upper plate 49 and a lower plate 50. These plates are connected together and in parallel relationship by a pivot shaft 51. The upper quadrant plate 49 is provided with a pair of retention slots 52 and 52' disposed at right angles to one another and aligned with the central pivot axis 53 of the pivot shaft 51. Each of the slots 52 and 52' is provided with flexible retention fingers 54 which are constituted by a rubber strip 55 secured under the upper plate 49 by a retention bar 56 and fasteners 57. These fingers 54 protrude within the slots 52 and 52' and are oriented to formed in the free end edge of the slot 52 and 52'.

The lower plate 50 is provided with a pair of retention channels 59 also disposed in alignment with a respective one of the slots 52 and 52' whereby to receive therein and frictionally retain a lower folded edge 60 of the thrice folded bag or bags 15''', as shown more clearly in FIG. 3.

As shown more clearly in FIG. 5, each of the channels 59 are provided with a plurality of spaced apart rubber fingers 61 extending within the channel 59, and guided by an angulated forward edge 62 of the lower plate 50. The channel 59 is formed by an L-shaped bracket 63 which is secured to the lower plate 50 by the retention holding bar 65. The width of the channel 59 may be adjusted by providing elongated slots 66 in the lower wall 63' of the bracket 63.

As previously described, the slots 52 and 52, and their associated channels 59 are aligned with the slot 42 in the second stationary tray 41, and when the fold former blade 45 pushes the bag 15 through the slot 41 and through the slots 52 or 52' and associated channels 59, the rubber fingers 54 and 61 will hold the thrice folded bags 15''' by friction to permit the former blade 45 to be 15''' in a vertical orientation. The orientation bag support frame 48 is now ready to displace the bags 15''' to a discharge position.

As shown in FIG. 2, there are two collector troughs, namely troughs 49' and 49'', positioned side by side whereby to simultaneously receive a thrice folded bag , or bags 15'' therein when the orientation by support frame is displaced to a discharge position. As shown more. clearly in FIG. 1, the pivot shaft 51 of this bag support frame 48 is secured to an axially rotatable drive constituted by a pinion gear 70 secured to the shaft 51 under the lower quadrant plate 50, and disposed in toothed engagement with a toothed rack 71 which is secured to a piston rod 72 of piston 73. The stroke of the piston 73 is also controlled by the controller 30 and in synchronism with the entire operation of the bag folding machine. The stroke of the piston 73 is calculated whereby to rotate the orientation bag support frame 48 through a 90 degree angle whereby when one of the slots, such as slot 5', is in a loading position in alignment with the slot 42 in the second stationary support tray, the other slot 52 is disposed immediately in front of its associated collector trough, herein collector trough 49''. Discharge means in the form of a pusher plate 74 connected to a piston 75 is disposed in alignment with a respective one of the inlet ends 76 of each of the troughs 49=, 49'' whereby in the forward stroke it engages the plastic folded bags 15''' and pushes them into their respective collector troughs 49', 49''. These bags are retained upright in the troughs by a vertical displaceable wall 77 or other means well known to a person skilled in the art. Accordingly, it can be appreciated that with the orientation bag support frame 48 of the present invention the operation of the bag folding machine is continuous in that simultaneously with the loading of the support frame 48, an unloading operation takes place. After this cycle the empty slot 52 is then moved to the loading position, and the loaded slot 52 is moved in alignment with the trough 49' for discharge.

After a predetermined number of plastic bags have been discharged within the collector troughs 49', 49'', a group identification mechanism 80 is actuated by the controller 30 whereby to position an indicating element in the form of a rod 81 in front of the last loaded bag in the trough. The bags continue to be loaded in the trough and an operator, at a convenient time, pushes the group of bags behind the finger 41 into a collector tray 82 located at the rear end 76' of the troughs. The predetermined number of bags which have been counted by the counter 31 associated with the controller 30 is then positioned into a carton 83 by holding the groups of bag in the collector 82 and tilting it on its inverted and the bags are released by the operator to fall within the carton 83 in a stacked arrangement.

Referring now to FIG. 6 there will be described the construction of the group identification means 80. It is pointed out that there is one of these identification mechanisms with each of the collector troughs 49', 49'', and only one is herein described. The identification mechanism 80 comprises a pivotally mounted guide rod 85 disposed over a respective one of the collector troughs. The indicator element 81 may be a pin or a blade, either rigid or flexible, and is secured to a slider housing 86 which is provided therein with a linear bearing 87 whereby to provide the minimum amount of friction with the rod 85. As the bags are loaded in the troughs the indicating finger 81 moves along the shaft 85.

As shown in FIG. 6, the mechanism 80 is shown in its retracted position. As soon as the controller 30 reaches a predetermined set count of bags located within the trough, it sends a signal to an actuating solenoid or cylinder 88 which actuates a pin 89 to move out of the cylinder housing 88 and push a pivot block 90 which causes the guide rod 85 to fall to an engaged position at 85' to position the finger 81 in its position of use. The entire mechanism 80 is displaceable on a pivot connection 91 of an attachment frame 92. Once the predetermined number of bags is discharged from the trough 49' or 49'' onto its associated collector tray 82, the operator also lifts the due to the support of the pivot block 90 having been placed back to the position as shown in FIG. 6. It is also pointed out that the cylinder 88 is only energized momentarily to trip the pivot block 90 and immediately becomes deenergized. Accordingly, it is possible to place back the guide 85 to its disengaged position without affecting the counter 31 in the controller 30.

Summarizing the method of operation of the bag folding machine of the present invention, it comprises the step of positioning a plastic bag 15 over a first support surface 16 and holding the plastic bag in this position and in alignment with the first holding means 18 by means of the sealer bars 14. As soon as the sealer bars are released an air jet from the conduit 19 pushes the central portion of the bag 15 into the first set of nip rolls 20 and 20' where the bag is formed and reoriented on a second conveyor 22 for discharge on a first stationary tray 27. At this position a single bag may be twice folded, or two or more bags accumulated, before the second folding means 29 is actuated. When actuated, the former blade 34 makes a second fold in the bag or bags 15' by pushing the bag substantially along a central region thereof through a second set of nip rolls 35 and 35' where the bag is twice folded and reoriented and discharged on a second stationary tray 41.

At the second stationary tray 41 the bags are thrice folded into an orientation bag support frame 48 where the thrice folded bags are retained against their opposed end edge regions and reoriented to a discharge position where they are then discharged into one of two troughs 49', 49''. When a thrice folded bag is discharged within a trough another bag is being loaded into another pair of holding slots of the bag support frame 48. After a predetermined number of bags are placed within each of the troughs, as determined by the counter 31 associated with the controller 30 and responsive to the closures of the sealer bars 14, an indicating rod 81 drops in front of the last loaded bag and moves along with the bags as they are loaded onto the troughs. An operator then can discharge the predetermined quantity of bags in the troughs, as indicated by the finger 81, onto a collector tray 82 which is then inverted, and the bags released into a carbon 83 positioned thereunder.

It is within the ambit of the present invention to cover any obvious modifications of the preferred embodiment described herein, provided such modifications fall within the scope of the appended claims.

We claim:

1. A bag folding machine comprising first conveying means for positioning a flat bag over a first support surface, holding means to hold said flat bag stationary over said first support surface in predetermined alignment with a first folding means, said first folding means effecting a first fold to said flat bag, second conveying means for positioning said folded bag on a second stationary support surface, second folding means for effecting a second fold to said folded bag, and third conveying means for positioning said twice folded bag onto a third stationary support surface, third folding means for imparting a third fold to said twice folded bag and including a bag support frame having spaced apart upper and lower bag engaging members for retaining an upper and a lower edge portion of said bag after being folded a third time and with said bag oriented substantially vertically, drive coupling means to move said bag support frame to a discharge position, and discharge means to push said bag out of engagement by said bag engaging members to transfer same to a collector means.

2. A bag folding machine as claimed in claim 1 wherein said bag is a plastic bag.

3. A bag folding machine as claimed in claim 2 wherein two or more of said flat bags are positioned one on top of the other on said second support surface and folded together by said second and third folding means.

4. A bag folding machine as claimed in claim 2 wherein said first support surface is an output conveyor having a plurality of spaced apart belts and disposed at an outlet of a plastic bag making machine, said holding means being constituted by a pair of sealer bars provided to seal one of opposed open ends of said bag as it is positioned on said output conveyor belt.

5. A bag folding machine as claimed in claim 4 wherein said first folding means is constituted by a bag pushing means disposed under said output conveyor substantially mid-length of said bag positioned on said conveyor, and a pair of pinch rolls disposed above said conveyor in alignment with said pushing means and closely spaced to said bag to grasp said mid-length portion of said bag when pushed between said pinch rolls and effect said first fold.

6. A bag folding machine as claimed in claim 5 wherein said bag pushing means is an air conduit having upwardly directed jets disposed between said belts to push said mid-length portion of said bag between said pinch rolls.

7. A bag folding machine as claimed in claim 6 wherein one of said pinch rolls is part of a first belt conveyor constituting said second conveying means, and a deflector for directing said bag out of said pinch rolls and into the mouth of a further pair of pinch rolls constituted by said one of said pinch rolls which is part of said second conveying means which is a belt conveyor, and a third pinch roll to eject said first fold bag on said second conveying means.

8. A bag folding machine as claimed in claim 5 wherein said second stationary support surface is a first collector tray having guide walls to support one or more of said once folded bags in juxtaposition.

9. A bag folding machine as claimed in claim 8 wherein said second folding means is constituted by a slot formed in said first collector tray and extending substantially central therealong and beyond an opposed edge of said bag(s) positioned thereover, and a fold former blade disposed above said first collector tray and in alignment with said slot, said fold former blade being actuated to push said bag(s) positioned on said first collector tray through said slot and into engagement with a second set of pinch rolls to effect said second fold.

10. A bag folding machine as claimed in claim 9 wherein said fold former blade is secured to a piston rod which is actuated by control when said sealer bars reach a predetermined number of sealing operations.

11. A bag folding machine as claimed in claim 9 wherein said second set of pinch rolls are further connected to said third conveying means which is a further belt conveyor to eject said twice folded bag on said third stationary support surface which is a second collecting tray.

12. A bag folding machine as claimed in claim 11 wherein said orientation support means is a bag support frame having spaced apart upper and lower bag engaging members for retaining an upper and a lower edge portion of said third folded bag with said bag oriented substantially vertically, drive coupling means to move said bag support frame to a discharge position, and discharge means to push said third folded bag out of engagement by said bag engaging members.

13. A bag folding machine as claimed in claim 12 wherein said third stationary support surface is provided with a slot, said twice folded bag being oriented on said third stationary support surface with said slot disposed substantially across a mid-section thereof, a fold former blade disposed above said third stationary support surface and actuable to push said twice folded bag through said slot to effect said third fold and into engagement with said bag engaging members of said bag support frame.

14. A bag folding machine as claimed in claim 13 wherein said upper bag engaging member is provided with a retention slot positioned in alignment with said slot in said third stationary support surface, said lower bag engaging member also being provided with a retention channel positioned in alignment with said other slots.

15. A bag folding machine as claimed in claim 13 wherein said retention slot is provided with flexible retention fingers in opposed elongated side edges thereof for frictional engagement with said upper edge portion of said bag when positioned therein.

16. A bag folding machine as claimed in claim 1 wherein said third stationary support surface is provided with a slot, said twice folded bag being oriented on said third stationary support surface with said slot disposed substantially across a mid-section thereof, a fold former blade disposed above said third stationary support surface and actuable to push said twice folded bag through said slot to effect said third fold and into engagement with said bag engaging members of said bag support frame.

17. A bag folding machine as claimed in claim 16 wherein said upper bag engaging member is provided with a retention slot positioned in alignment with said slot in ' said third stationary support surface, said lower bag engaging member also being provided with a retention channel positioned in alignment with said other slots.

18. A bag folding machine as claimed in claim 17 wherein said retention slot is provided with flexible retention fingers in opposed elongated side edges thereof for frictional engagement with said upper edge portion of said bag when positioned therein.

19. A bag folding machine as claimed in claim 18 wherein said retention channel is provided with frictional retention fingers in a side wall thereof.

20. A bag folding machine as claimed in claim 18 or 19 wherein said retention fingers are flexible rubber fingers.

21. A bag folding machine as claimed in claim 17 wherein said upper bag engaging member is provided with two of said retention slots, each slot being disposed at right angles to one another and extending from a common pivot point of said support frame, said lower bag engaging member also having two of said retention channels disposed at right angle to one another and oriented in alignment with respective ones of said two retention slots.

22. A bag folding machine as claimed in claim 21 wherein said upper and lower bag engaging members are quadrant shaped plates secured spaced apart and substantially parallel to one another by a common pivot shaft, said pivot shaft being secured to an axially rotatable drive to reorient said retention slots alternatively to a respective right angle bag discharge position.

23. A bag folding machine as claimed in claim 22 wherein said axially rotatable drive is constituted by a pinion gear secured to an extension drive portion of said pivot post, and a toothed rack in toothed engagement with said pinion gear and secured to a piston rod for axial displacement to cause said pivot post to rotate a quarter turn on its longitudinal axis, said piston rod displacing both said retention slots and associated retention channels to their respective discharge positions when actuated to an extended and retracted stroke respectively.

24. A bag folding machine as claimed in claim 22 wherein there are two of said collector means, each collector means being a collector trough disposed adjacent each discharge position of said bag support frame, and a collector tray associated with each said trough for transferring a predetermined number of said folded bags into a container.

25. A bag folding machine as claimed in claim 24 wherein said collector trays are pivotally connected under a bottom wall thereof to invert said trays into an open top end container supported thereunder.

26. A bag folding machine as claimed in claim 22 wherein there is further provided identification means to identify a predetermined number of said bags positioned in said collector troughs.

27. A bag folding machine as claimed in claim 26 wherein said holding means to hold said flat bag stationary over said first support surface is constituted by a pair of sealer bars provided to seal one of opposed open ends of said bag, and a counter for counting each sealing operation of said sealer bars, said counter actuating said identification means upon reaching a predetermined number of sealing operations.

28. A bag folding machine as claimed in claim 27 wherein said identification means comprises a pivotally mounted guide rod disposed over a respective one of said collector troughs, an indicating element secured to a slider element slidingly secured to said guide rod with said indicating element depending therefrom, said guide rod being displaced from a retracted position where said indicating element is disposed above said folded bags in said troughs to an operating position where said indicating element is at least a portion thereof disposed against an outer wall of a last discharged folded bag.

29. A bag folding machine as claimed in claim 28 wherein said slider element is a sleeve member slidingly supported about said guide rod, said indicating element being a pin secured at one end to said sleeve and depending therefrom.

30. A bag folding machine as claimed in claim 29 wherein said guide rod is normally positioned at said retracted position, and an actuating piston having a cylinder rod actuable by said counter upon reaching said a pivot block to cause said guide rod to drop to said operating position.

31. A method of folding a plastic bag comprising the steps of:

(i) positioning a plastic bag over a first support surface;

(ii) holding said plastic bag over said first support surface in predetermined alignment with a first folding means;

(iii) effecting a first fold to said plastic bag;

(iv) conveying said once folded plastic bag onto a second stationary support surface;

(v) effecting a second fold to said first folded plastic bag;

(vi) conveying said twice folded plastic bag onto a third stationary support surface;

(vii) effecting a third fold to said second folded plastic bag pushing said second folded plastic bag through a slot in said third stationary support surface and through an upper bag engaging slot and a lower bag engaging channel of a bag orienting support means to effect a third fold, said upper bag engaging slot and lower bag engaging channel being spaced apart to engage opposed edge portions of said bag;

(viii) orienting said thrice folded plastic bag to a position for transfer into a collector means;

(ix) transferring said thrice folded plastic bag into said collector means.

32. A method as claimed in claim 31 wherein said step (ii) comprises holding said plastic bag between a pair of sealer bars while sealing an open end of said bag, severing said bag from an elongated tubular plastic film, and releasing said sealer bars while simultaneously blowing a mid-length portion of said bag between a pair of nip rolls to effect said step (iii).

33. A method as claimed in claim 31 wherein said step (iii) also includes deflecting said folded bag onto a second conveyor to effect said step (iv).

34. A method as claimed in claim 31 wherein said step (iv) comprises accumulating two or more of said plastic bag on a collector tray constituting said second stationary support surface.

35. A method as claimed in claim 31 wherein said step (v) comprises pushing said once folded bag through a slot in said second stationary support surface and between a second set of nip rolls to effect said second fold.

36. A method as claimed in claim 31 wherein said step (viii) comprises pivotally displacing said bag orienting support means to a discharge position.

37. A method as claimed in claim 36 wherein said step (ix) comprises pushing said bag held by said bag orienting support means into a collecting trough.

38. A method as claimed in claim 37 wherein there is further provided the step of pushing another second folded bag in a second bag orienting support means while said thrice folded bag in a first bag orienting support means is being transferred to a first collecting trough, and pivotally displacing said bag orienting support means to transfer said thrice folded bag in said second bag orienting support means in a second trough and reloading said first bag orienting support means.

39. A method as claimed in claim 37 wherein there is further provided the step of:

(x) identifying a predetermined number of bags positioned in juxtaposition in said collecting trough.

40. A method as claimed in claim 39 wherein said step (x) comprises counting by means of a counter the number of closures of a pair of sealer bars; and positioning an indicating element adjacent a last discharged folded bag of a predetermined count of closures of said sealer bars, said sealer bars when closed effecting said step (ii).

41. A method as claimed in claim 40 wherein there is further provided the step of:

(xi) displacing said predetermined number of bags from said collecting trough onto a collector tray; and (xii) discharging said collector tray into a container.

42. A method as claimed in claim 41 wherein said step (xii) comprises inverting said collector tray on a bottom pivot connection while holding said predetermined number of bags therein, and releasing said bags n an open top end container aligned thereunder.

43. A method as claimed in claim 41 wherein after (xiii) displacing said indicating element to a retracted position.

* * * * *